US005154448A

United States Patent [19]

Griffin et al.

[11] Patent Number: 5,154,448

[45] Date of Patent: Oct. 13, 1992

[54] SCRATCH-OFF MARKING LABEL

[76] Inventors: Jeffrey Griffin; Claudia Griffin, both of 1911 Barbara Dr., Palo Alto, Calif. 94303

[21] Appl. No.: 685,190

[22] Filed: Apr. 15, 1991

[51] Int. Cl.[5] ..... B42D 15/00

[52] U.S. Cl. ..... 283/102; 283/75; 283/81

[58] Field of Search ..... 283/56, 102, 74, 75, 283/81

[56] References Cited

U.S. PATENT DOCUMENTS 4,621,837 11/1986 Mack ..... 283/56 X
4,872,707 10/1989 deBruin ..... 283/102

FOREIGN PATENT DOCUMENTS 2462481 6/1977 Fed. Rep. of Germany ..... 283/102

*Primary Examiner*—Timothy V. Eley
*Assistant Examiner*—Willmon Fridie, Jr.

[57] ABSTRACT

A layered label for containers and the like. The label has for the outermost layer, a thin scratchable surface that when scratched, reveals a contrasting color below. By scratching through the surface of the label, one may legibly write information on the label. The label allows consumers to conveniently record information on an article with a fingernail and therefore without the need for a writing implement. The label may be a single layer of scratchable coating over a contrasting color on the surface of the container, or it may be three layers, in which the scratchable coating is the top layer applied over a base label of contrasting color with pressure sensitive adhesive and a peel away backing on the bottom layer.

4 Claims, 1 Drawing Sheet

SCRATCH-OFF MARKING LABEL

BACKGROUND

1. Field of the Invention

This invention relates to labels which are used on cans, jars, tubes, bags and bottles, etc. and specifically to a label which provides a "scratch-off" (as in a lottery game piece) field.

2. Description of Prior Art

Manufacturers of beverages and other consumables commonly label containers to identify the contents and brand identity. These labels are intended to convey information, brand, image, add appeal and arouse consumer interest. Labelling such as this is not intended to altered by the consumer.

Thereafter, inventors have created labels which can be removed by the consumer to expose promotional material such as "cents-off" coupons or a scratch-off lottery type game piece, U.S. Pat. No. 4,846,504 to MacGregor et al. (1989). In construction, the "scratch-off lottery type game piece" is somewhat similar to the Scratch-Off Marking Label. However, the prior art was invented to provide manufacturers with the option of providing promotional game pieces and "cents-off" coupons on products. The object of scratching the label of the "scratch-off lottery type game piece" in the prior art is to expose a hidden cents-off coupon, a winning game piece, or some other information. These promotional labels were not invented to solve the same problem that the proposed invention for a Scratch-off Marking Label seeks to solve.

The problem which the prior art has not addressed is the need for a method for marking containers with information or identification which is so simplified, that containers which heretofore were not commonly marked with information, will now be marked with helpful information. An example of this is the marking of beer cans or disposable cups at a party with the name of the person who is drinking from them. This reduces the confusion and subsequent waste involved in losing your open can subsequent to setting it down amidst other identical cans or cups. Rather than taking a chance drinking from the wrong container, most people will open a new can or pour a fresh drink thus wasting the remainder of the lost drink. Or, the person may simply pick up any container and begin drinking thus increasing the possibility for the spread of viruses and bacteria.

OBJECTS AND ADVANTAGES

Accordingly, several of the objects and advantages of our invention are:

(a) to provide a container label which allows for the inputting of information and identification on a container thus aiding the consumer by increasing convenience, safety and the reduction of waste;

(b) to provide a container label which allows a simplified method (you only need your fingernail) for recording information and identification on the container, thus obviating the need for a writing implement;

(c) to provide a container label which eliminates the permanency problems which can be encountered between various writing implements when used on various containers and coatings; and (d) to provide manufacturers with a new, unique label for existing products which, because it has such a high degree of usefulness over ordinary labels, can increase sales of products which carry the label.

Further objects and advantages are to provide a container label which is simple to use, inexpensive to produce and does not take up space normally used by the manufacturer for labels which are presently used. Still further objects and advantages will become apparent from a consideration of the ensuing description and drawings.

DRAWING FIGURES

REFERENCE NUMERALS IN DRAWINGS

| | |
|---|---|
| 10 typical container | 50 adhesive coating |
| 20 scratch-off label | 60 scratch-off coating |
| 30 scratched lines | 70 non-stick backing |
| 40 colored substrate | 80 container wall |

DESCRIPTION—FIGS 1 TO 3

Figure 1:
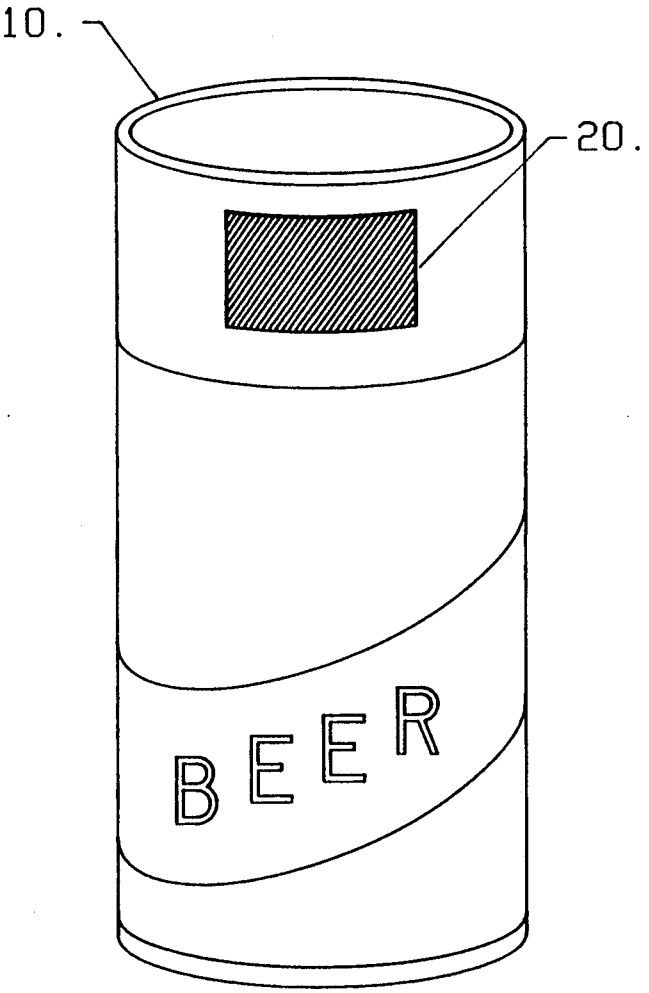
FIG. 1 is a perspective view of our label invention on a can.
Figure 4:
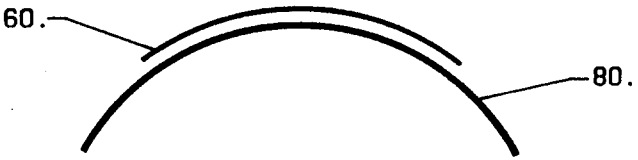
FIG. 4 is an exploded view of the cross section of the scratch-off coating applied to the container.

A typical embodiment of the scratch-off marking label invention is illustrated in FIG. 1 which gives an overall view of the label invention 20 on a typical container 10. FIG. 4 shows an exploded view of the cross section of the scratch-off coating 60 applied directly onto a container 80. The scratch-off coating 60 is a thin layer of pigmented paraffin or other kind of wax, plastic or other substance which is applied through a rolling, spraying or stamping process such as is normally used to make scratch-off lottery-type game pieces. The coating remains intact on the container following manufacture, transportation and retailing but is easily scratched cleanly off of the container with a fingernail to make lines by exposing the surface directly underneath the coating 80. The ease of visibility of the scratched lines is due to the contrasting of color and shade between the scratch-off coating 60 and the color and shade of the container beneath the coating 80. Scratches through the coating will make neat lines because the coating will not chip or flake when it is scratched.

The dimensions of the scratch-off marking label invention 20 will vary with the sizes of the containers and the intended uses for the label. However, if the label were used on a beer can so that the consumer could write his name on the can, the size of the label would be the area that a typical person needs to write his first name (probably 0.75" high × 1.25" long).

Figure 2:
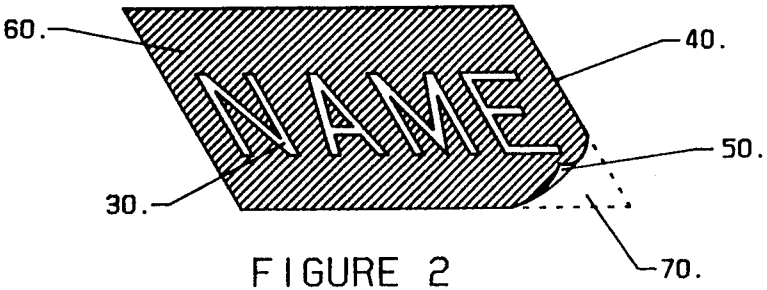
FIG. 2 is a perspective view of our label invention on an adhesive-backed substrate (sticker).
Figure 3:
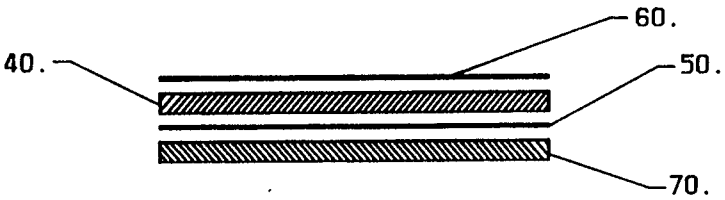
FIG. 3 is a perspective view of the layered construction of the label.

An additional embodiment of the invention is shown in FIG. 2 and FIG. 3. FIG. 2 shows a scratch-off marking label which consists of the scratch-off coating 60 applied on a paper or plastic substrate 40 with the corner peeled back to expose the adhesive 50 which is applied to the back of the label.

FIG. 3 illustrates the layered construction of this label. The paper or plastic substrate 40 is in between the scratch-off coating 60 and the adhesive 50. The adhesive is covered with a paper or plastic backing 70 which is coated as is normally used on "stickers" so as to release easily from the adhesive 50 so that it may be removed to expose the adhesive prior to use of the label. The substrate 40 can be an ordinary label stock which is purchased with an adhesive backing or may be bonded with adhesive or other process to the container during the labelling process. The scratch-off marking label may be manufactured on a label stock which utilizes pressure sensitive adhesive so that the label can be sold by itself and applied by the consumer to an article of choice such as a bottle, a sheet of paper, clothing, a cardboard box, plastic bag, fruit, sporting goods, airline ticket, etc. Or, the adhesive may be solvent activated for use by a manufacturer or consumer for applying the scratch-off labels to an article of choice such as those mentioned above.

The scratch-off coating is the applied to the side of the label stock which is opposite the adhesive or bonding side using a rolling, stamping or spraying process such as is normally used in the production of lottery-type scratch-off game pieces.

From the description above, a number of advantages of our scratch-off marking label invention become evident:

(a) Since the process and materials used to make the scratch-off marking label differ very little from the processes and materials currently used to label containers and to make lottery tickets, the manufacturing of the scratch-off label would not involve undue risk and expense.

(b) The information recorded on the label will be easily read due to the use of contrasting colors and shades between the scratch-off coating and the base color.

(c) The label is small enough that it will not normally interfere with the current container labelling.

(d) The adhesive-backed embodiment of the scratch-off label allows manufacturers and consumers the convenience of the scratch-off labels along with the freedom to label articles which would be difficult to label such as a sandwich bag.

OPERATION—FIGS

The manner of using the scratch-off label invention to record identification or other information on a container or other item differs slightly from an ordinary scratch-off lottery type game piece. Rather than to scratch off the scratch-off coating in a broad area, one forms letters, numbers or figures by scratching through the coating 60 to make easily visible lines 30. The user can then form a name, date or some other kind of pertinent information on the label as desired. The lines are preferably made by scratching the surface with a fingernail, but can also be made using a coin or other implement which can be used to scratch through the scratch-off coating 60.

The operation of the stick-on scratch-off label, which is shown in FIGS. 2 and 3 is the same as above, however, there is the additional step of removing the backing 70 to expose the adhesive 50 and adhering the label by joining the exposed adhesive with the article to be labelled.

SUMMARY, RAMIFICATIONS, AND SCOPE

Accordingly, the reader will see that the scratch-off label invention serves to fill the need for a simple, inexpensive method for quickly and easily identifying, or placing other information on a variety of containers and other articles. No prior art exists for such a label which has all of these advantages it can be used without the need for a writing implement, one just scratches through the coating to write one's name or other data;

it is relatively small and does not interfere with currently used labelling;

it can help to reduce waste and promote hygiene by helping the user of a container to locate his container;

it does not have the permanency problems which are usually experienced when using a variety of writing implements on various container surfaces;

it gives manufacturers a unique packaging feature which can be promoted for the benefit of increased sales.

it can be used on a variety of articles and materials thus allowing for other uses of the scratch-off label on plastic, paper, cloth, etc.

Although the description above contains many specificities, these should not be construed as limiting the scope of the invention but as merely providing illustrations of some of the presently preferred embodiments of this invention. Thus, the scope of the invention should be determined by the appended claims and their legal equivalents, rather than by the examples given.

What is claimed is:

1. A scratch-off label for permitting a user to write thereon without the use of a marking implement, comprising:

a permanent base having a colored near side which is normally visible to the user and having a far side; and a coating of scratch off non-transparent material having a color which contrasts with the color of the near side of the permanent base, which coating is applied directly onto the near side of the permanent base with sufficient thickness so as to obscure the color of the permanent base, and which when scratched off reveals the color of the near side of the permanent base.

2. The scratch-off label of claim 1, further comprising:

a clear coating between the scratch-off coating and the near side of the permanent base.

3. The scratch-off label of claim 1, further comprising:

an adhesive material on the far side of the permanent base.

4. The scratch-off label of claim 3, further comprising:

a backing over the adhesive material for protecting the adhesive material.

* * * * *